US005882009A

United States Patent [19]

Schaefer

[11] Patent Number: 5,882,009

[45] Date of Patent: Mar. 16, 1999

[54] WAGERING CARD GAME BASED ON SUITS ONLY

[76] Inventor: Craig M. Schaefer, 6506 Pinehurst Drive, Vancouver, British Columbia, Canada, V4X 4P1

[21] Appl. No.: 864,825

[22] Filed: May 29, 1997

[51] Int. Cl.[6] ..... A63F 1/00

[52] U.S. Cl. ..... 273/292

[58] Field of Search ..... 273/274, 292, 273/303, 304, 305, 306

[56] References Cited

U.S. PATENT DOCUMENTS

| | | | |
|---|---|---|---|
| 4,836,553 | 6/1989 | Suttie | 273/292 |
| 4,861,041 | 8/1989 | Jones et al. | 273/292 |
| 5,078,405 | 1/1992 | Jones et al. | 273/309 |
| 5,098,107 | 3/1992 | Boylan et al. | 273/292 |
| 5,141,234 | 8/1992 | Boylan et al. | 273/306 |
| 5,288,077 | 2/1994 | Jones | 273/303 X |
| 5,288,081 | 2/1994 | Breeding | 273/292 |
| 5,320,356 | 6/1994 | Cauda | 273/292 |
| 5,417,430 | 5/1995 | Breeding | 273/292 |
| 5,636,843 | 6/1997 | Roberts | 273/292 |
| 5,713,573 | 2/1998 | Nazaryan | 273/292 |
| 5,713,574 | 2/1998 | Hughes | 273/292 |

*Primary Examiner*—William E. Stoll
*Attorney, Agent, or Firm*—Norman M. Cameron

[57] ABSTRACT

A method of playing a wagering game between a dealer and one or more players includes the step of each player placing a first wager based on one or more card combinations selected from a fixed number of types of card combinations. One or more first cards are revealed. The dealer appropriates wagers which are no longer winnable in view of these first cards. One wagering player may place a second wager based on the one or more card combinations. One or more second cards are revealed. The dealer appropriates wagers which are no longer winnable in view of the one or more second cards. Preferably there are five types of combinations, namely four cards of a single suit, four cards all of a different suit, one pair, two pairs and three cards of a single suit.

5 Claims, 5 Drawing Sheets

WAGERING CARD GAME BASED ON SUITS ONLY

BACKGROUND OF THE INVENTION

This invention relates to wagering games involving a dealer, one or more players and using one or more decks of cards having a plurality of suits.

Many card games have been developed and some are particularly adapted for gambling. One class of such games includes a dealer who deals cards and a plurality of players who place wagers based on the cards that the dealer deals. One such game is blackjack.

Various progressive jackpot wagering games have also been developed. For example, U.S. Pat. No. 5,288,081 to Breeding discloses a method of playing a wagering card game using standard poker hand rankings. Each player places a wager. Cards are dealt to each player and at least one common card, all face down. Each player is given a chance to examine his or her cards and withdraw at least part of his or her wager. The common card is shown, thereby providing a hand for each player. The wagers are resolved based on the remaining wager which was not withdrawn. Preferably two common cards are dealt face down. These are turned up one at a time and each player is given a choice of withdrawing or leaving at risk the previously wagered amount on each occasion. A similar game is shown in U.S. Pat. No. 5,417,430, also to Breeding.

U.S. Pat. No. 5,141,234 to Boylan et al., discloses card game where each player can optionally increase a bet. The wagering is on the net total of a hand. This is equal to the gross total of added numerical values of the symbols of at least one suit less a gross total of added numerical values of the symbols of another suit.

Some other prior patents also disclose the concept of adding additional wagers when additional cards are dealt. An example is U.S. Pat. No. 5,320,356 to Cauda.

However, there is a demand for new card games, particularly by casinos, which are, at the same time, innovative and interesting, but simple enough for players to easily learn. It has been found that many potential players are discouraged from playing because they do not understand the complexity of the game and are self-conscious about showing their lack of expertise.

Accordingly, it is an object of the game to provide an improved wagering game, particularly for casinos, which is innovative and interesting.

It is also an object of the invention to provide an improved wagering game for casinos which is simple enough for most persons to understand without complicated instructions.

It is a further object of the invention to provide an improved wagering game for casinos which uses only casino industry accepted equipment such as a gaming table and cards.

SUMMARY OF THE INVENTION

In accordance with these objects, there is provided, according to one aspect of the invention, a method of playing a wagering game between a dealer and one or more players. The method comprises the steps of each player placing a first wager based on one or more card combinations selected from a fixed number of types of card combinations. One or more first cards are revealed. The dealer appropriates wagers which are no longer winnable by the players in view of said one or more first cards. At least one player then places a second said wager. One or more second cards are revealed. The dealer appropriates wagers which are no longer winnable by the players in view of said one or more second cards.

The method may continue until a fixed number of cards are exposed.

According to another aspect of the invention there is provided a method of playing a wagering game between a dealer and one or more players using a deck of cards with a plurality of suits. The method comprises the steps of each player placing a first wager based on one or more card combinations to be exposed. Each combination includes a specified number of cards of any suit. Preferably the suits in each combination are unspecified. A plurality of cards is revealed. The first wagers are resolved according to the card combinations which are exposed.

The players may optionally repeat said wagers after the plurality of cards are revealed. Subsequently further cards are revealed and play continues until a fixed number of cards are exposed.

For example, four cards in total may be exposed. The wagers are of five types, namely four cards of a single suit, four cards all of a different suit, one pair, two pairs each of different suits, and three cards of a single suit.

DESCRIPTION OF THE PREFERRED EMBODIMENTS

A game according to the invention employs a standard fifty-two deck of cards in this example. However the game could be played with multiple decks of cards, decks of cards with cards added, decks of cards with cards deleted or special configured decks of cards. It also could be played by means of computer software or a special mechanical apparatus similar to a slot machine. The term "card game" includes these alternatives.

Figure 1:
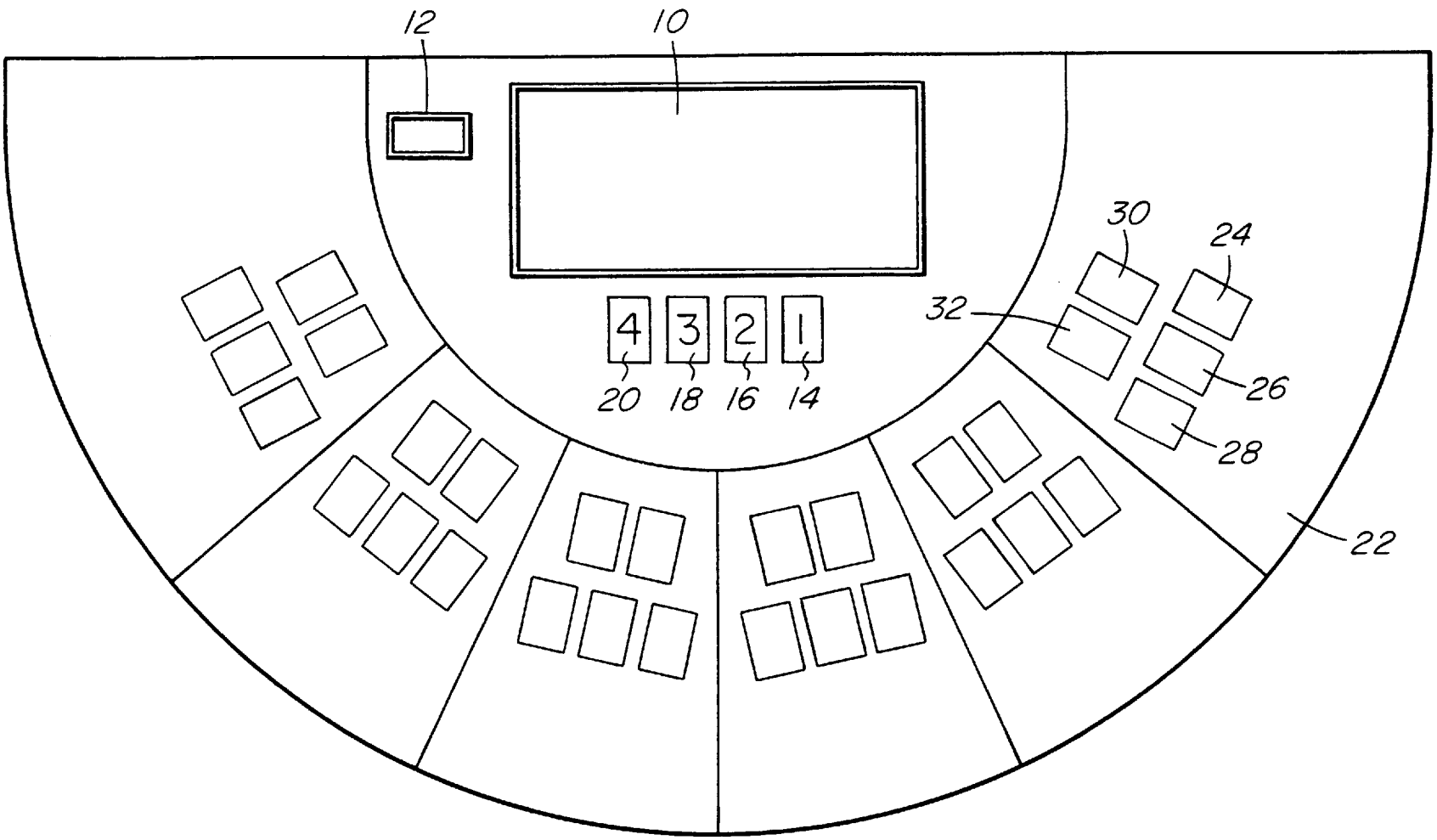
FIG. 1 is a top plan view of a game table layout according to an embodiment of the invention with one betting round.
Figure 2:
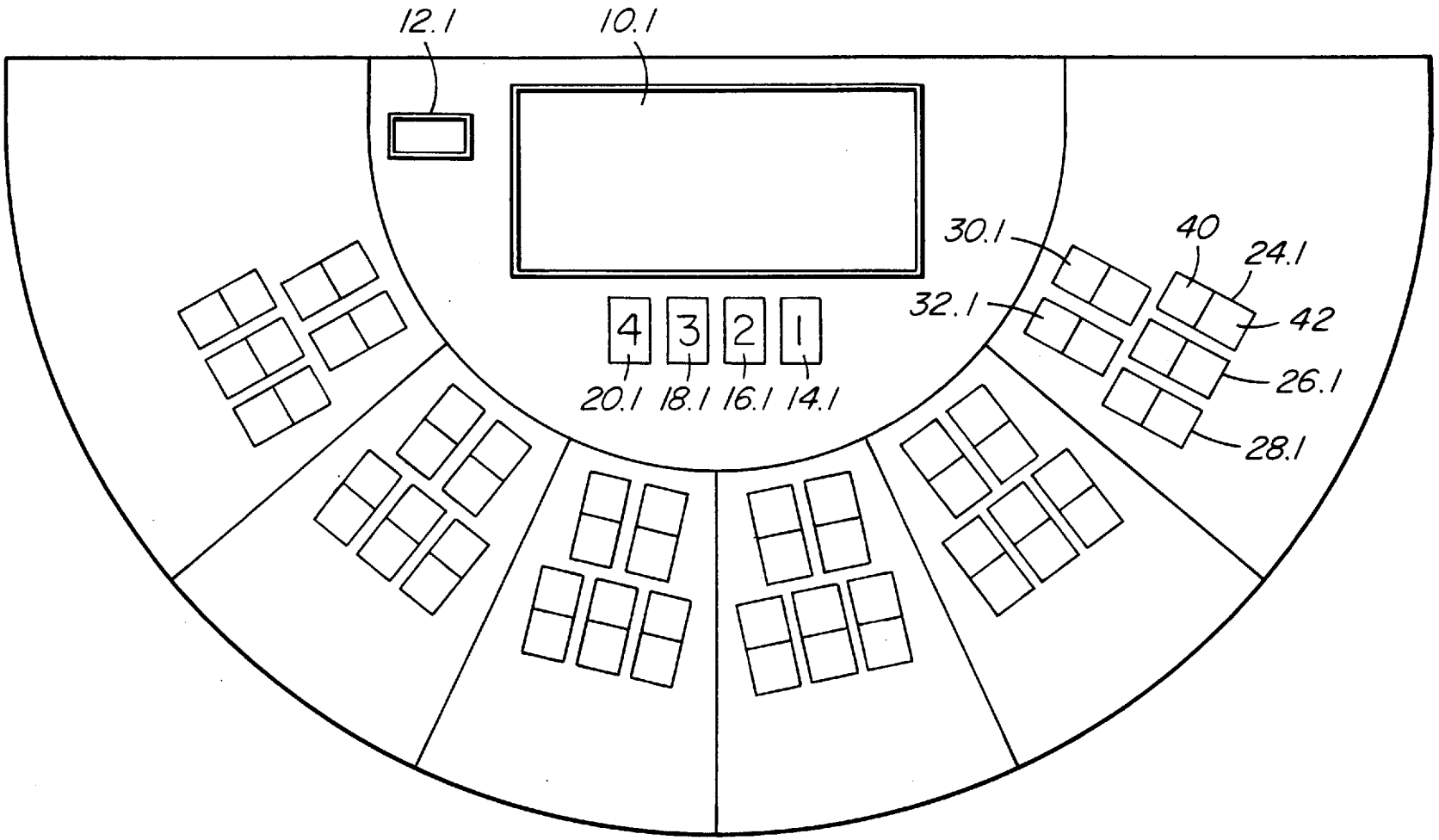
FIG. 2 is a view similar to FIG. 1 for two betting rounds.
Figure 3:
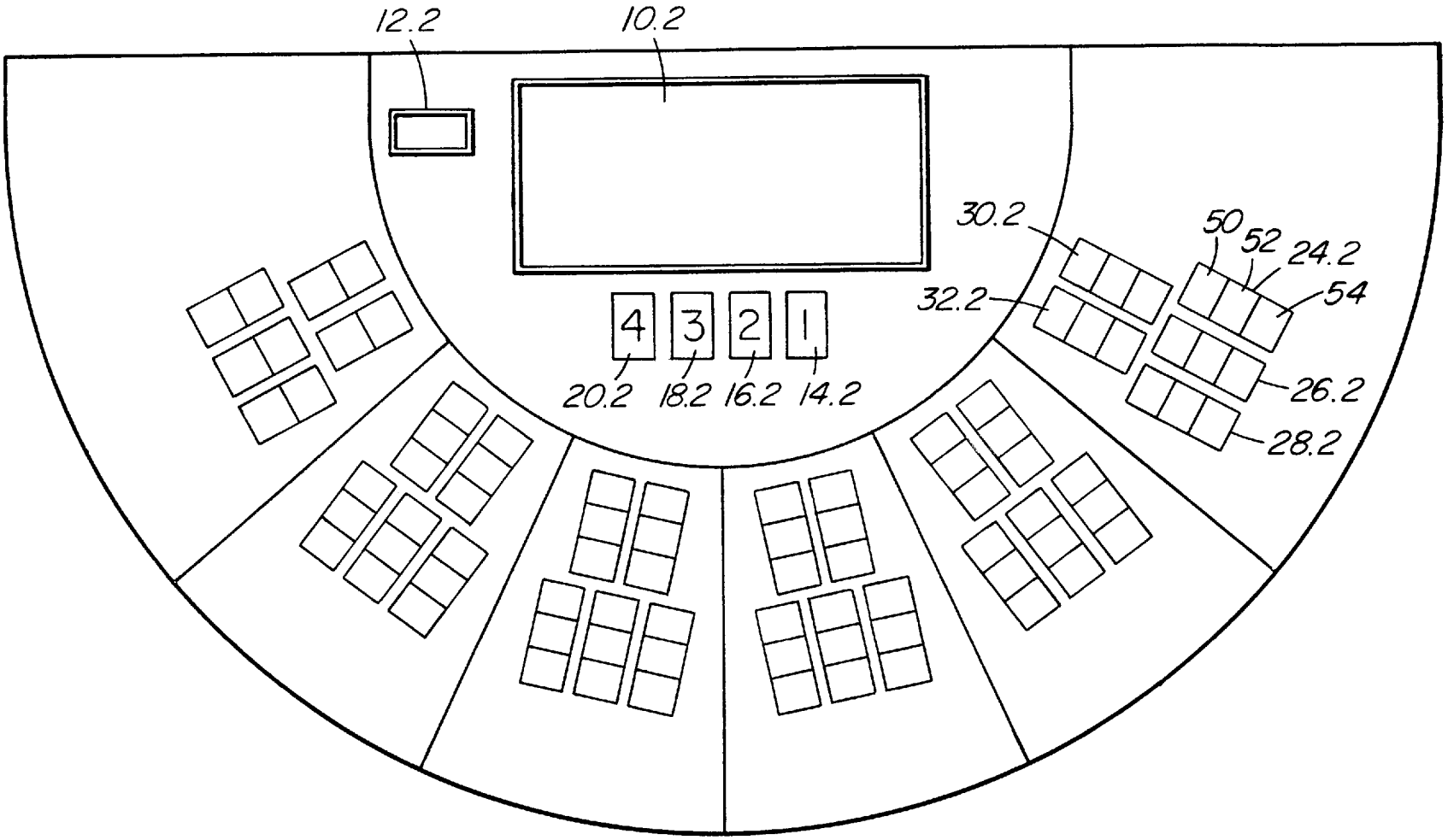
FIG. 3 is a view similar to FIG. 2 for three betting rounds.

FIG. 1–3 show table layouts for the game. FIG. 1 shows a typical table layout for one round of betting including a chip tray 10, a discard tray 12 and a four rectangular spaces 14, 16, 18 and 20 used to display cards dealt by the dealer. There is a series of player betting areas 22, six in this example, although arrangements could be provided for any reasonable number of players. Each player betting area has, in this example, five rectangular spaces 24, 26, 28 and 30 and 32, each of which is provided for a different type of bet as disclosed below.

FIG. 2 shows a similar arrangement. Similar parts have similar numbers with the additional designation "0.1". Here however the layout is designed for two betting rounds. Each of the rectangles 24.1–30.1 is divided into two portions, such as portions 40 and 42 of rectangle 24.1. Rectangle 40 is utilized for a first round of betting and rectangle 42 for a second round.

Similarly FIG. 3 shows an arrangement for three rounds of betting. Here equivalent parts have the same numbers as in FIG. 1 with the additional designation "0.2". In this example, the rectangles are divided into three smaller rectangles, such as rectangles 50, 52 and 54 within rectangle 24.2 for three separate rounds of betting.

This card game revolves around bets on specifically card combinations. The player does not have to specify any particular suit. Numerical values of cards do not count either in this game.

The types of bets in this example are as follows where a total of four cards are dealt from a conventional 52 card deck:

A—Four cards, all of the same suit. For example, there may be four hearts, four clubs, four spades or four diamonds.

B—All four cards dealt have a different suit.

C—Two of four cards have the same suit. The remaining two cards are of different suits from the pair and different from each other.

D—Two pairs, each pair being a different suit.

E—Three of the four cards having the same suit.

The dealer initially shuffles the cards in the conventional manner. Each player then places bets on the player betting areas. He or she may place bets in any number of the rectangles 24, 26, 28, 30 and 32 according to the five different combination of bets A–E described above which will have been revealed when all four cards are exposed. In this example spaces 32, 30 , 28, 26 and 24 are respectively used for bet types A, B, C, D and E respectively. The player places chips on any or all of the rectangles according to the amount he or she wishes to bet on each of the betting types.

After the bets are made, the dealer turns over one or more cards, two cards in this example, and places them in rectangles 14 and 16 respectively. Some types of bets are now clearly impossible. The dealer appropriates such wagers. For example, if the first two cards are of a single suit, such as clubs, then bet type B will be impossible. If the game has only one betting round, then all four cards are dealt and the wagers resolved.

The game may go on to two rounds using the configuration of FIG. 2 or 3. The players may then place additional bets based on the types of bets which remain feasible after the first two cards have been revealed. Optionally these bets may be restricted to the same types of bets made in the first round. The dealer then reveals a third card and places it in rectangle 18.1 or 18.2. Again, some types of bets may become impossible. If so, the dealer removes the lost wagers. If the game has only two betting rounds the remaining cards are dealt with and the wagers are resolved.

A third round of betting may then occur using the layout of FIG. 3. The players may place additional bets. Afterwards the dealer turns over a final card and places it in rectangle 20.2. Wagers are then resolved. The house takes losing wagers and pays players based on the odds of winning any particular bet in any particular round.

Figure 4:
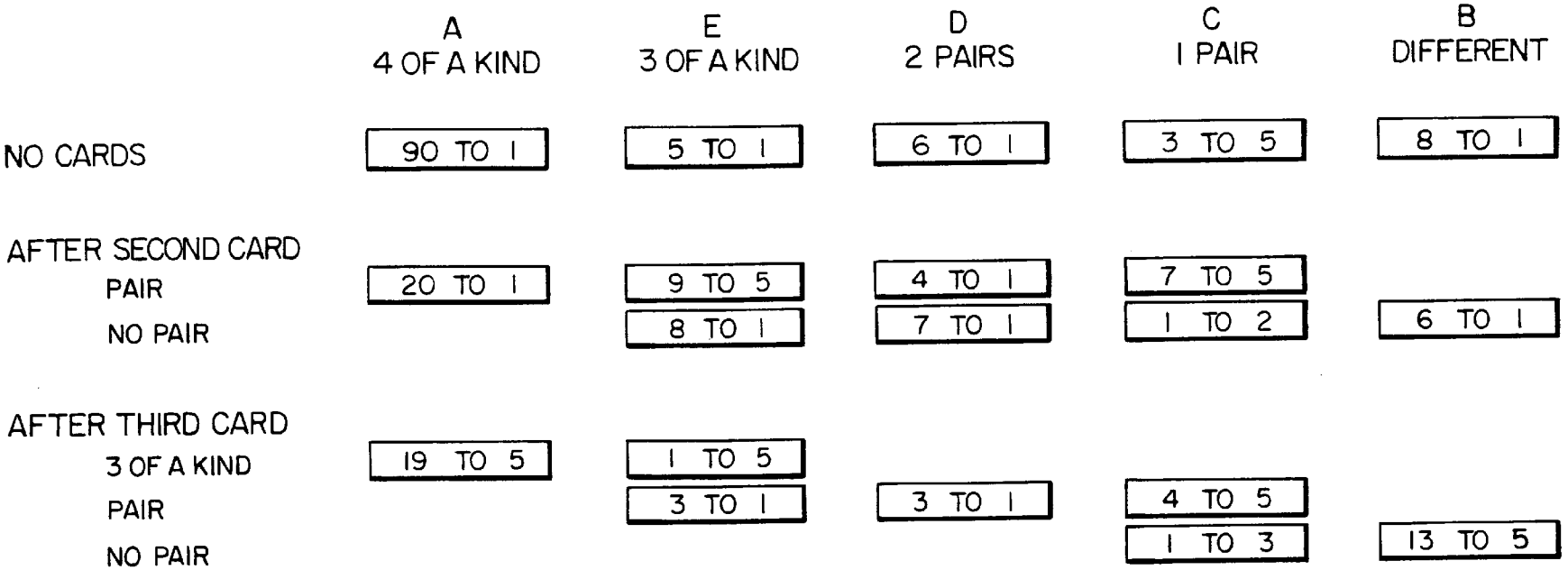
FIG. 4 is a chart showing odds a player will be paid based on different bets and different rounds.
Figure 5:
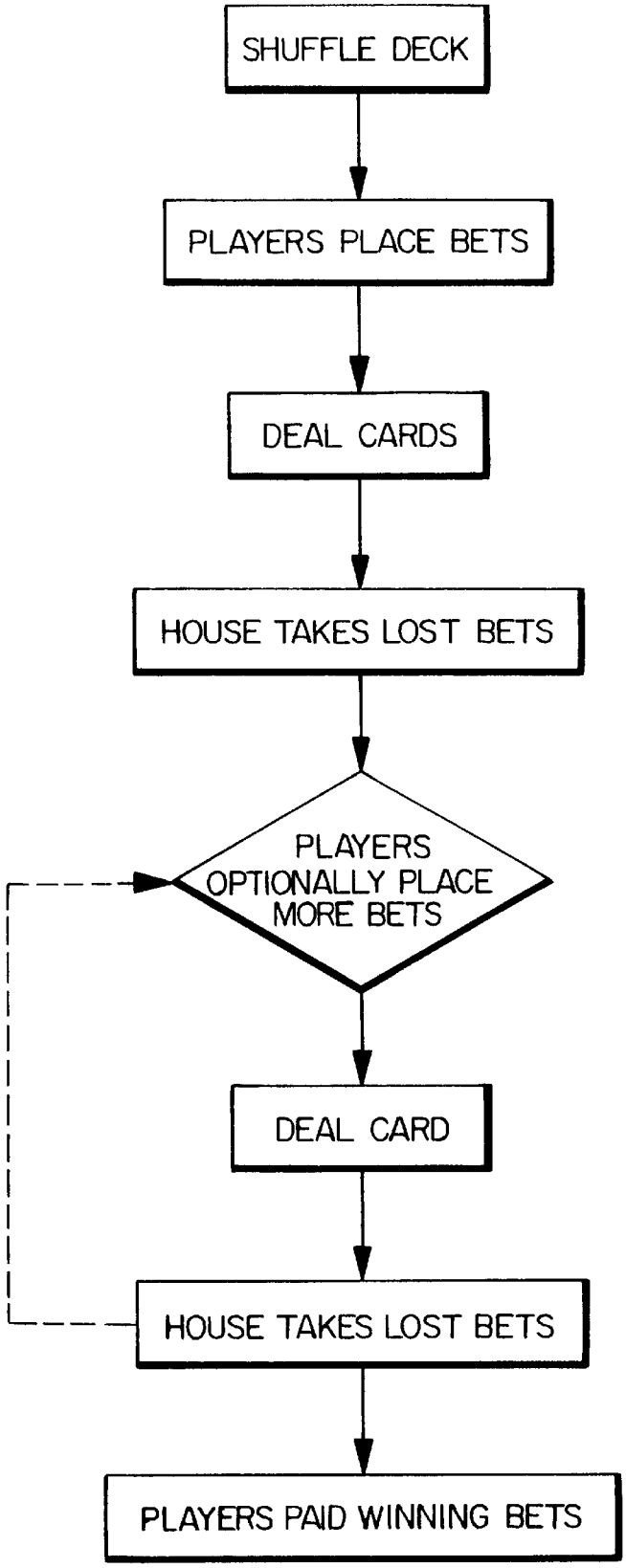
FIG. 5 is a flowchart showing a game according to the invention.

FIG. 4 shows the odds paid to a player for each type of bet made prior to any cards being revealed, after the second card is revealed and after the third card is revealed.

Variations of the game are possible. Some are described above. Alternatively, for example, a fifth card may be turned over if a progressive jackpot is used. As another alternative, only one, two or three common cards could be revealed. Remaining cards are given to each player so each player has a unique card combination.

A further alternative employs the same game, but the player gives a commission on his or her wager to the house, and another player then "banks" the table. The casino retains the commission as a service fee. The players collect or pay the winning bets of the other players or the dealer.

In another variation the player may specify the suit of cards to be exposed in each combination. Typically the pay off would be higher than if the suit were unspecified.

It will be understood by someone skilled in the art that many of the details described above are by way of example only and are not intended to limit the scope of the invention which is to be interpreted with reference to the following claims.

What is claimed is:

1. A method of playing a wagering card game between a dealer and one more or more players using a fifty-two card deck having four suits, comprising the sequential steps of:

each player placing a first wager and specifying one or more card suit combinations selected from a fixed number of card suit combinations, the card suit being four cards of a single suit, four cards all of different suit, two cards of a single suit, two sets of two cards of a single suit each, and three cards of a single suit;

revealing two or more cards;

the dealer appropriating wagers which are no longer winnable in view of said at least two or more cards;

at least one player placing a second wager and specifying one or more of said card suit combinations;

revealing one or more additional cards; and the dealer appropriating wagers which are no longer winnable in view of said one or more additional cards.

2. A method as claimed in claim 1, wherein play continues until no further winnable wagers remain.

3. A method as claimed in claim 1, wherein play continues until a fixed number of cards are exposed.

4. A method as claimed in claim 3, wherein at least one card is exposed as a common card for all players and at least one card is individually dealt to each player.

5. A method as claimed in claim 1, wherein there are two first cards revealed, then one of said one or more additional cards and then a fourth card is revealed.

* * * * *